US009732708B2

(12) United States Patent
Neher et al.

(10) Patent No.: US 9,732,708 B2
(45) Date of Patent: Aug. 15, 2017

(54) INTERNAL COMBUSTION ENGINE

(71) Applicant: Mahle International GmbH, Stuttgart (DE)

(72) Inventors: Stefan Neher, Salach (DE); Peter Geskes, Ostfildern (DE); Oliver Grill, Moetzingen (DE)

(73) Assignee: Mahle International GmbH, Stuttgart (DE)

( * ) Notice: Subject to any disclaimer, the term of this patent is extended or adjusted under 35 U.S.C. 154(b) by 0 days.

(21) Appl. No.: 14/997,476

(22) Filed: Jan. 15, 2016

(65) Prior Publication Data

US 2016/0208745 A1 Jul. 21, 2016

(30) Foreign Application Priority Data

Jan. 16, 2015 (DE) ..... 10 2015 200 657

(51) Int. Cl.
*F02D 9/00* (2006.01)
*F02D 21/00* (2006.01)
(Continued)

(52) U.S. Cl.
CPC ..... *F02M 26/31* (2016.02); *F28D 9/0043* (2013.01); *F28D 21/0003* (2013.01); *F28F 9/002* (2013.01); *F02M 26/12* (2016.02)

(58) Field of Classification Search
CPC ..... F02M 26/00; F02M 26/31; F02M 26/12; F28D 21/0003; F28D 9/0043; F28D 9/002
(Continued)

(56) References Cited

U.S. PATENT DOCUMENTS 6,360,702 B1 * 3/2002 Osada ..... F28D 7/0066 123/196 AB
8,726,889 B2 * 5/2014 Cockerill ..... F02B 29/0418 123/540
(Continued)

FOREIGN PATENT DOCUMENTS

DE 102004003790 A1 8/2005
EP 1099847 A2 5/2001
(Continued)

OTHER PUBLICATIONS

English abstract for JP-2001254648.
English abstract for JP-2009156488.
German Search Report for DE102015200657.3, mailed Dec. 16, 2015.

*Primary Examiner* — Nicholas J Weiss
*Assistant Examiner* — Dapinder Singh
(74) *Attorney, Agent, or Firm* — Fishman Stewart PLLC

(57) ABSTRACT

An internal combustion engine may include a housing and at least one cavity arranged therein for receiving a coolant flow. An exhaust gas cooler may be provided for cooling an exhaust gas flow. The exhaust gas cooler may be configured as a stacked disc cooler including at least two stacking discs, an exhaust gas inlet, a cover plate and a screw-mounting plate for screw-mounting to the housing. The exhaust gas cooler may protrude into the cavity of the housing when the screw-mounting plate is mounted to the housing. The screw-mounting plate may have a spacer element disposed at the exhaust gas inlet. The spacer element may protrude in a direction of the at least two stacking discs and enlarge a distance between the screw-mounting plate and an adjacent stacking disc of the at least two stacking discs to position the exhaust gas cooler further into the cavity.

20 Claims, 3 Drawing Sheets

(51) Int. Cl.

| | |
|---|---|
| ***F01N 3/20*** | (2006.01) |
| ***F02M 26/31*** | (2016.01) |
| ***F28F 9/00*** | (2006.01) |
| ***F28D 9/00*** | (2006.01) |
| ***F28D 21/00*** | (2006.01) |
| *F02M 26/12* | (2016.01) |

(58) Field of Classification Search
USPC ..... 60/320, 605.2
See application file for complete search history.

(56) References Cited

U.S. PATENT DOCUMENTS

| | | | | |
|---|---|---|---|---|
| 2008/0184974 | A1* | 8/2008 | Kobayashi ..... | F02M 26/26<br>123/568.12 |
| 2008/0257536 | A1 | 10/2008 | Kolblin et al. | |

FOREIGN PATENT DOCUMENTS

| | | | |
|---|---|---|---|
| JP | 2001254648 | A | 9/2001 |
| JP | 2009156488 | A | 7/2009 |
| WO | WO-2007/003303 | A1 | 1/2007 |

* cited by examiner

INTERNAL COMBUSTION ENGINE

CROSS-REFERENCE TO RELATED APPLICATIONS

This application claims priority to German Patent Application No. 10 2015 200 657.3, filed Jan. 16, 2015, the contents of which are hereby incorporated by reference in its entirety.

TECHNICAL FIELD

The present invention concerns an internal combustion engine with a housing and at least one cavity arranged therein through which a coolant can flow for cooling the internal combustion engine, and with an exhaust gas cooler for cooling exhaust gas to be supplied to a combustion process.

BACKGROUND

Exhaust gas coolers are used today in order to be able to reduce the emission of nitrous oxides and particulates significantly. Part of the exhaust gas is diverted in the exhaust gas manifold and then conducted through the exhaust gas cooler where it is cooled. The cooled exhaust gas is then mixed with the aspirated fresh air and supplied as a mixture to the internal combustion engine again for combustion. Because of the comparatively high exhaust gas temperatures, such an exhaust gas cooler is exposed to high thermal load, wherein the cooler in all cases must be dimensioned and configured such that it is not damaged because of the comparatively high exhaust gas temperatures.

Exhaust gas coolers are in principle either bolted directly to the internal combustion engine via brackets, or mounted on fixed brackets and then attached with clamping straps. The exhaust gas cooler here has a housing in which pipes are installed which carry the exhaust gas and about which coolant can flow. Exhaust gas coolers which are integrated in a cavity of the housing of the internal combustion engine, for example an engine block or a crankcase, and hence can be connected directly to the cooling system of the internal combustion engine, constitute a significant simplification.

EP 1 099 847 A2 describes a generic internal combustion engine with a housing and cavities arranged therein through which a coolant can flow for cooling the internal combustion engine. The internal combustion engine here also has an exhaust gas cooler for cooling exhaust gas to be supplied to a combustion process. As well as the exhaust gas cooler, in addition an oil cooler is also integrated in the cooling circuit of the internal combustion engine, wherein the exhaust gas cooler is further away from the main coolant flow than the oil cooler, which carries the risk that insufficient coolant will flow through the exhaust gas cooler. Rather, the exhaust gas cooler protrudes slightly and here forms a dead space. Thus the thermal sustainability may be limited.

DE 10 2004 015 487 A1 discloses an internal combustion engine with a crankcase and a cylinder head, to which an exhaust manifold and a fresh gas pipe are attached. These two pipes are connected to an exhaust gas cooler via an exhaust gas recirculation line, with an exhaust gas recirculation valve connected in the exhaust gas recirculation line. In order to be able to improve the mounting of the exhaust gas recirculation device on the internal combustion engine, the housing of the exhaust gas cooler is an integral part of the crankcase in at least one part region.

EP 2 036 097 A1 discloses a further generic internal combustion engine, as does WO 2007/003303 A1.

The disadvantage with the exhaust gas coolers known today is that these are comparatively costly and are constructed from many individual components, even for low performance requirements for the exhaust gas cooler itself. The high costs are due in particular to the comparatively costly housing which is up to 2 mm thick.

SUMMARY

The present invention tackles the problem of producing an improved or at least alternative embodiment for an internal combustion engine of the generic type which allows an effective and simultaneously economic exhaust gas cooling.

This problem is achieved by the subject of the independent claim(s). Advantageous embodiments are the subject of the dependent claims.

The present invention is based on the general concept of positioning an exhaust gas cooler in a cavity arranged in a housing of a corresponding internal combustion engine, hence integrating it directly in a coolant circuit of the internal combustion engine, and arranging it lower in the cavity of the internal combustion engine thanks to a specially designed spacer element, hence in a manner optimised for heat transmission. The internal combustion engine according to the invention for this has a housing with cavities arranged therein through which coolant can flow and thus cool the internal combustion engine. In addition, the internal combustion engine according to the invention has an exhaust gas cooler for cooling exhaust gas to be supplied to a combustion process. According to the invention, the exhaust gas cooler is formed as a stacked disc cooler with at least two stacking discs, a cover plate and a screw-mounting plate for screw-mounting to the housing of the internal combustion engine. In the state screw-mounted to the housing, the exhaust gas cooler protrudes into a cavity of the housing of the internal combustion engine through which a coolant flows.

The spacer element may be a separate spacer piece, such as for example a metal ring, a bush or a sheet metal part, but it is also conceivable that the spacer element is formed as a dish moulded out of the screw-mounting plate and hence formed integrally with the screw-mounting plate. The latter constitutes a preferred embodiment since this can be implemented economically and without further assembly cost. With a separate configuration of the spacer element, this is connected, for example soldered, welded or bolted, to adjacent components, in particular to the screw-mounting plate. Both the dish and the separate spacer piece enlarge a distance between the screw-mounting plate and the adjacent stacking disc, and in this way position the exhaust gas cooler lower in the cavity. The lower positioning of the exhaust gas cooler or its stacking discs in the cavity allows the coolant to flow better around this and hence cool the exhaust gas flowing therein. At the same time, with the spacer element produced on the exhaust gas inlet according to the invention, a significantly better coolant flow around the exhaust gas inlet region can be ensured, whereby the thermal fatigue strength and the life expectancy of the exhaust gas cooler may be increased.

In an advantageous refinement of the solution according to the invention, at least the stacking discs and the screw-mounting plate are soldered, welded or bolted together. Particularly preferred is complete soldering of both the stacking discs block to the individual stacking discs, and of the screw-mounting plate or cover plate to the sacking disc block. In this way, in particular preassembly of the exhaust gas cooler is possible.

In a further advantageous embodiment of the solution according to the invention, the spacer element is simultaneously configured as a baffle element. In order to achieve as even a flow as possible of the exhaust gas to be cooled through the exhaust gas cooler, the spacer element may be formed as a baffle element and hence in particular so-called dead zones can be avoided. In addition, with the spacer element formed as a baffle element, an even flow through the exhaust gas cooler is forced, whereby a higher heat transmission and hence effective exhaust gas cooling are possible.

In an advantageous refinement, it is proposed that the spacer element has a surface-enlarging structure on the outside, in particular beads, studs or ribs. In this way, the heat-transmitting surface area can be enlarged and the thermal exchange improved.

Suitably, the depth a of the spacer element is at least 5 mm. By means of a depth a of at least 5 mm, the spacer element is particularly well flushed with coolant and hence cooled optimally, which further improves the thermal fatigue strength.

In a further advantageous embodiment of the solution according to the invention, a distance b between an exhaust gas channel formed by two stacking discs and the screw-mounting plate is at least 8 mm. In this way, because of the air cushion lying between the first exhaust gas channel and the screw-mounting plate, an effective insulating layer can be created which prevents a critical thermal load on the connecting plate in this region.

In a further advantageous embodiment of the solution according to the invention, an embossed (exhaust gas) deflection channel is provided on the screw-mounting plate in the region of the exhaust gas outlet, wherein additionally between the screw-mounting plate and the adjacent stacking disc, an intermediate plate is arranged which at the exhaust gas outlet has a dish formed in the direction of the adjacent stacking disc. Like the dish in the exhaust gas inlet, this may evidently also be formed as a separate spacer piece. In this way, it is possible that the cooled exhaust gas emerging from the exhaust gas cooler at the outlet side can be collected in an exhaust gas deflection channel embossed into the screw-mounting plate, and for example transferred directly to an exhaust gas overflow channel in the internal combustion engine, and conducted to the cold side of the internal combustion engine.

Suitably, an exhaust gas recirculation valve is arranged on the screw-mounting plate in the region of the exhaust gas inlet, in particular bolted on via threaded bolts arranged on the screw-mounting plate. These threaded bolts may be welded to the connecting plate and allow comparatively simple preassembly of the exhaust gas recirculation valve on the connecting plate. Screw-mounting the exhaust gas recirculation valve via threaded bolts arranged on the screw-mounting plate furthermore allows the exhaust gas recirculation valve to be fixed indirectly, via the threaded bolts and screw-mounting plate, to the engine, i.e. the internal combustion engine, whereby the vibration transmission to the stacked disc block is at least reduced.

Further important features and benefits of the invention arise from the subclaims, the drawings and the associated description of the figures with reference to the drawings.

It is clear that the features listed above and to be explained in more detail below can be used not only in the combination given but also in any other combination or alone without leaving the scope of the present invention.

Preferred exemplary embodiments of the invention are depicted in the drawings and explained in more detail in the description below, wherein the same reference numerals are used for the same or similar or functionally equivalent components.

BRIEF DESCRIPTION OF THE DRAWINGS

The drawings show diagrammatically.

DETAILED DESCRIPTION

Figure 1:
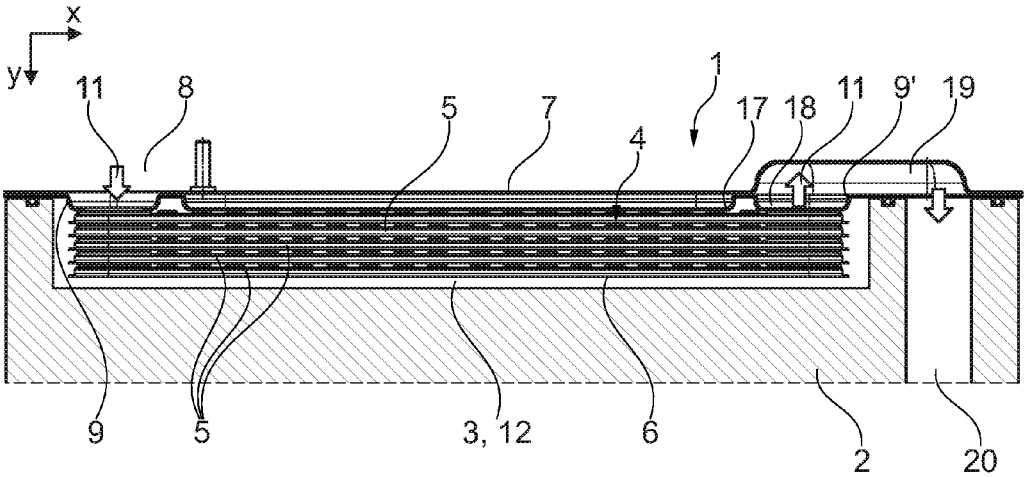
FIG. 1 a cross-section view through an internal combustion engine according to the invention, FIG. 2 a depiction of a detail in the region of an exhaust gas inlet from FIG. 1 with a spacer element formed as a dish, FIG. 3 a front view of an exhaust gas cooler, FIG. 4 a top view and a section view through an exhaust gas cooler with exhaust gas recirculation valve, FIG. 5 a depiction of a detail in the region of an exhaust gas inlet with a spacer element formed a separate spacer piece.
Figure 2:
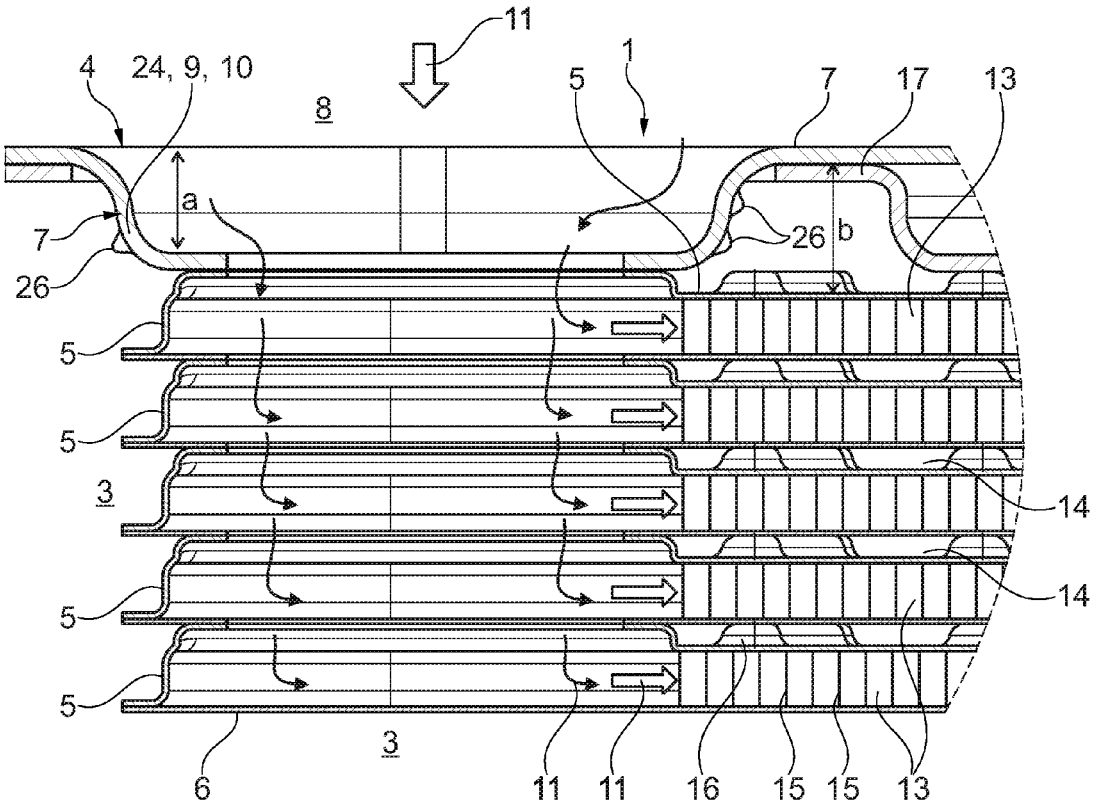
Figure 3:
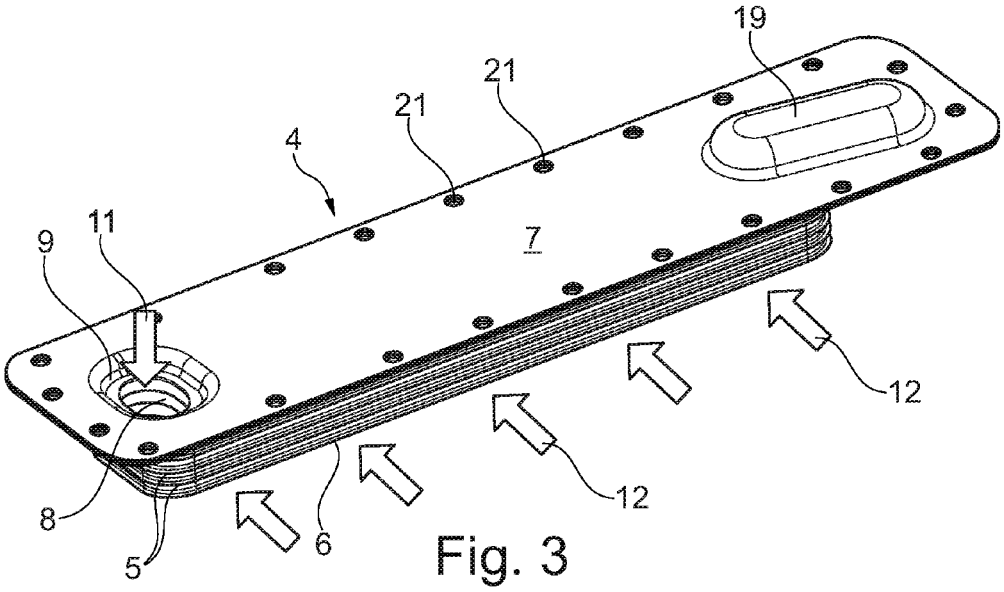
Figure 4:
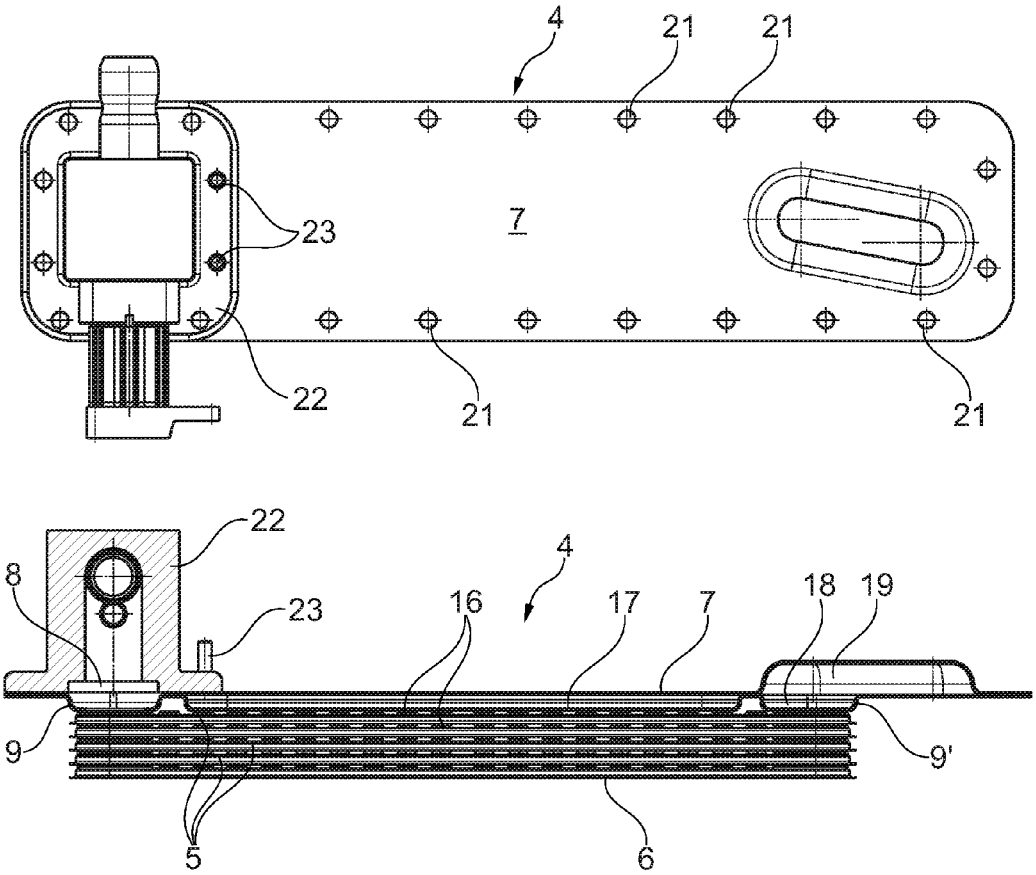
Figure 5:
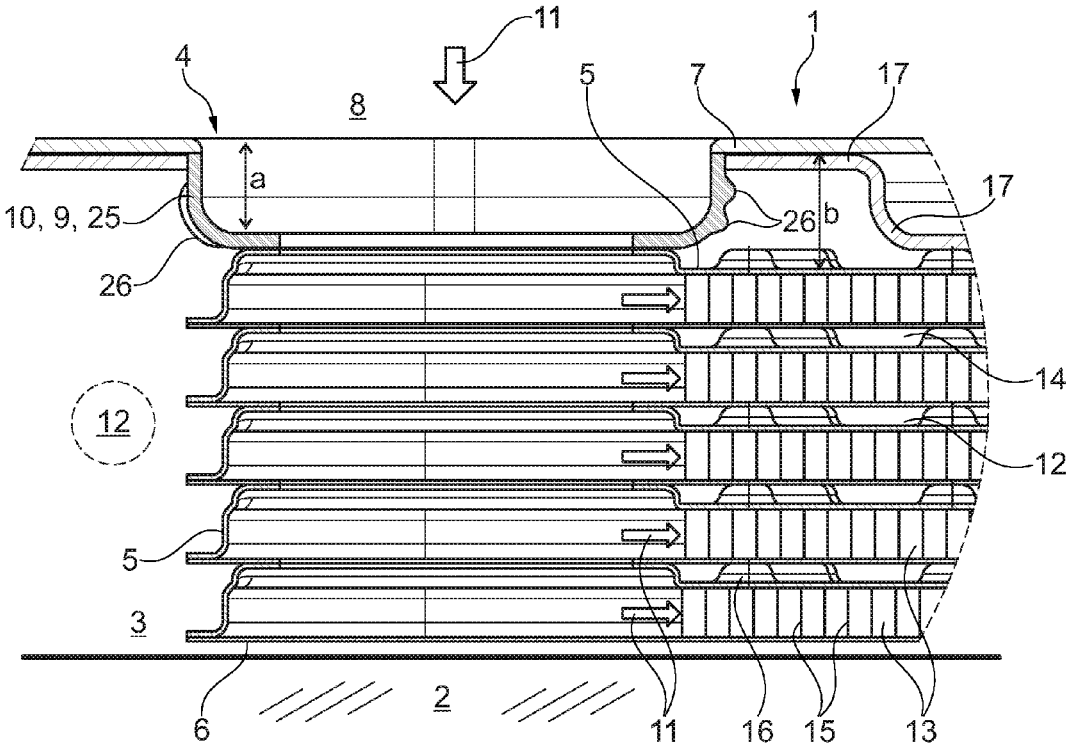

According to FIGS. 1, 2 and 5, an internal combustion engine 1 according to the invention has a housing 2 with a cavity 3 arranged therein. A coolant 12 flows through the cavity 3 and thus cools the internal combustion engine 1. Furthermore, the internal combustion engine 1 according to the invention has an exhaust gas cooler 4 (see also FIGS. 3 and 4) for cooling an exhaust gas to be supplied to a combustion process. Due to the exhaust gas recirculation, in particular the nitrous oxides and particulate emissions are reduced.

Looking further at FIGS. 1 to 5, we see that the exhaust gas cooler 4 is formed as a stacked disc cooler and has a plurality of stacking discs 5, a cover plate 6 and a screw-mounting plate 7 for screw-mounting to the housing 2 of the internal combustion engine 1.

As can be seen particularly clearly from FIG. 1, in the state mounted, i.e. screw-mounted, on the housing 2, the exhaust gas cooler 4 protrudes into the cavity 3 of the housing 2 through which the coolant 12 flows, so that coolant 12 flowing into the cavity 3 can flow through the stacking discs 5.

According to the invention, the screw-mounting plate 7, at least at an exhaust gas inlet 8, also has a spacer element 9 formed in the direction of the adjacent stacking disc 5, i.e. here in the Y-direction, which increases the distance between the screw-mounting plate 7 and the adjacent stacking disc 5, and hence positions the gas cooler 4 more deeply in the cavity 3 in the Y-direction. This achieves in particular a better flow of coolant 12 through the stacking discs 5, i.e. the heat transmission block of the exhaust gas cooler 4, and hence these are cooled better. The spacer element 9 may be configured either as a dish 24 (see FIG. 2) formed integrally from the screw-mounting plate 7, or as a separate spacer piece 25 (see FIG. 5), in particular a plate, a ring, a sheet metal element, a sleeve or a bush. The latter is then connected, in particular bolted, soldered or welded, to the screw-mounting plate 7. In addition or alternatively, it may also be connected to the first stacking disc 5.

Independently of the embodiment of the spacer element 9, this may have a surface-enlarging structure 26 on the outside, in particular beads, studs or ribs, as shown for example in FIGS. 2 and 5. In this way, because of the enlarged surface area, the heat transmission can be significantly improved in particular in the temperature-critical region of the exhaust gas inlet 8.

Suitably, at least the stacking discs 5 and the screw-mounting plate 7 are soldered, welded or bolted together. Evidently, normally the entire exhaust gas cooler 4, consisting of the cover plate 6, stacking discs 5 and screw-mounting plate 7, is soldered so that the exhaust gas cooler 4 can not only be produced reliably sealed and systematically, but also at the same time preassembled.

In a further advantageous embodiment of the solution according to the invention, the spacer element 9 is simultaneously configured as a baffle element 10 and in this way forces an even flow of exhaust gas 11 through the exhaust gas cooler 4 which is optimal in regard to heat transmission. A depth a of the spacer element 9 here is at least 5 mm, as shown according to FIG. 2, whereby it is possible to install the exhaust gas cooler 4 deeply in the cavity 3 of the housing 2 of the internal combustion engine 1 and hence arrange the exhaust gas cooler 4 in the main coolant flow. A distance b between an exhaust gas channel 13 formed by two stacking discs 5 and the screw-mounting plate 7 is at least 8 mm.

A coolant channel 14 through which the coolant 12 flows is in each case arranged between two adjacent exhaust gas channels 13. A height $h_{AGK}$ of an exhaust gas channel 13 formed by two stacking discs 5 is here between 4 and 8 mm, whereas a height $h_{KFK}$ of a coolant channel 14 formed between two stacking discs 5 is between 2 mm and 10 mm, in particular between 2 mm and 5 mm. Evidently turbulence inserts 15 may be provided in the exhaust gas channel 13 which force an eddying of the exhaust gas 11 flowing in the exhaust gas channel 13 and thus improve the heat transmission. In the same way, studs 16 (see FIG. 2) may be arranged in the coolant channel 14 and cause an eddying of the coolant 12 and hence also improve the heat transmission.

Looking again at FIG. 2, we see that an intermediate disc 17 is arranged between the screw-mounting plate 7 and the immediately adjacent stacking disc 5, which at an exhaust gas outlet 18 (see FIGS. 1 and 3 and 4) has a dish 9' formed in the direction of the adjacent stacking disc 5. In this way it is possible to form a deflection channel 19 between the intermediate disc 17 and the screw-mounting plate 7, by means of which the cooled exhaust gas 11 emerging from the exhaust gas cooler 4 may for example be conducted into an exhaust gas overflow channel 20 (see FIG. 1), and guided in the housing 2 of the internal combustion engine 1, i.e. in the engine block, on the cold side of the internal combustion engine 2. Furthermore, passage openings 21 (see in particular FIGS. 3 and 4) are provided in the screw-mounting plate 7, which are designated as screw holes and via which the screw-mounting plate 7 and hence the exhaust gas cooler 4 can be screw-mounted to the housing 2 of the internal combustion engine 1.

In order to be able also to attach an exhaust gas recirculation valve 22 (see FIG. 4) to the screw-mounting plate 7 and hence to the exhaust gas cooler 4 as easily and quickly as possible, threaded bolts 23 may be provided on the screw-mounting plate 7, on which the exhaust gas recirculation valve 22 is positioned and secured by means of nuts (not shown). In this way, in particular, preassembly of the exhaust gas recirculation valve 23 to the exhaust gas cooler 4 is possible. The two threaded bolts 23 also allow positioning of the exhaust gas recirculation valve 22 relative to the screw-mounting plate 7, wherein the exhaust gas recirculation valve 22 is bolted directly to the engine block, i.e. the housing 2 of the internal combustion engine 1, at the other passage openings 21, via the screw-mounting plate 7.

With the internal combustion engine 1 according to the invention, the following advantages can be achieved:

- a high degree of integration,
- a significantly improved thermal fatigue strength due to excellent flushing of the exhaust gas inlet 8 and the achieved distance b between a screw-mounting plane and the plane of the first exhaust gas channel 13,
- simple mounting of an exhaust gas recirculation valve 22 by corresponding threaded bolts 23 on the screw-mounting plate 7,
- simple bolting of the exhaust gas recirculation valve 22 to the housing 2 (as far as possible) of the internal combustion engine 1, whereby low vibration loads are transmitted to the exhaust gas cooler 4,
- preassembly of the exhaust gas recirculation valve 22 to the screw-mounting plate 7 by the threaded bolts 23,
- integration of a deflection channel 19 by the use of an additional intermediate disc 17.

The invention claimed is:

1. An internal combustion engine, comprising:

a housing and at least one cavity arranged in the housing for receiving a coolant flow;

an exhaust gas cooler for cooling an exhaust gas flow to be supplied to a combustion process;

the exhaust gas cooler configured as a stacked disc cooler including at least two stacking discs, an exhaust gas inlet, a cover plate and a screw-mounting plate for screw-mounting to the housing;

the exhaust gas cooler protrudes into the at least one cavity of the housing through which the coolant flow is received;

wherein the screw-mounting plate includes a spacer element disposed at least at the exhaust gas inlet, the spacer element defining at least part of the exhaust gas inlet for guiding the exhaust gas flow into the exhaust gas cooler, wherein the spacer element protrudes in a direction of the at least two stacking discs and enlarges a distance between the screw-mounting plate and an adjacent stacking disc of the at least two stacking discs to position the exhaust gas cooler further into the cavity; and wherein the spacer element is structured as a baffle element for influencing the exhaust gas flow through the exhaust gas cooler.

2. The internal combustion engine according to claim 1, wherein the at least two stacking discs and the screw-mounting plate are secured together via at least one of a soldered connection, a welded connection and a bolted connection.

3. The internal combustion engine according to claim 1, wherein the spacer element has an internal cross-section defining an extent smaller in a region of the adjacent stacking disc than a region of the screw-mounting plate.

4. The internal combustion engine according to claim 1, wherein a depth of the spacer element is at least 5 mm.

5. The internal combustion engine according to claim 1, wherein a distance between an exhaust gas channel defined by the at least two stacking discs and the screw-mounting plate is at least 8 mm.

6. The internal combustion engine according to claim 1, wherein a height of an exhaust gas channel formed by the at least two stacking discs is between 4 mm and 8 mm.

7. The internal combustion engine according to claim 1, wherein a height of a coolant flow channel defined by the at least two stacking discs is between 2 mm and 10 mm.

8. The internal combustion engine according to claim 1, wherein the exhaust gas cooler further includes an exhaust gas outlet, and wherein at least one of:

an embossed deflection channel is disposed on the screw-mounting plate in a region of the exhaust gas outlet, and an intermediate plate is arranged between the screw-mounting plate and an adjacent stacking disc of the at least two stacking discs, and wherein the intermediate plate has another spacer element arranged at the exhaust gas outlet and protruding in a direction of the adjacent stacking disc.

9. The internal combustion engine according to claim 1, further comprising an exhaust gas recirculation valve arranged on the screw-mounting plate in a region of the exhaust gas inlet.

10. The internal combustion engine according to claim 9, wherein the exhaust gas recirculation vale is secured to the screw-mounting plate via threaded bolts, and wherein the threaded bolts are arranged on the screw-mounting plate.

11. The internal combustion engine according to claim 1, further comprising a surface-enlarging structure disposed on an external side of the spacer element with respect to the exhaust gas flow.

12. The internal combustion engine according to claim 1, wherein the spacer element has a dish shape defining an internal cross-section that decreases in the direction of the at least two stacking discs.

13. The internal combustion engine according to claim 12, wherein the spacer element is a separate spacer piece connected to the screw-mounting plate via at least one of a welded connection, a soldered connection and a bolted connection.

14. The internal combustion engine according to claim 13, wherein the separate spacer piece includes at least one of a plate, a ring, a bush and a sleeve.

15. The internal combustion engine according to claim 11, wherein the surface-enlarging structure includes at least one of a bead, a stud and a rib.

16. The internal combustion engine according to claim 12, wherein the spacer element is integral with the screw-mounting plate.

17. The internal combustion engine according to claim 1, further comprising an intermediate plate arranged between the screw-mounting plate and one stacking disc of the at least two stacking discs, and wherein the intermediate plate at an exhaust gas outlet of the exhaust gas cooler includes another spacer element arranged in a direction of the one stacking disc.

18. An internal combustion engine, comprising:

a housing and at least one cavity disposed in the housing for receiving a coolant flow;

an exhaust gas cooler for cooling an exhaust gas flow supplied to a combustion process, the exhaust gas cooler including a plurality of stacking discs, an exhaust gas inlet, and exhaust gas outlet, a cover plate and a mounting plate for connecting the exhaust gas cooler to the housing;

the exhaust gas cooler protrudes into the cavity of the housing;

a spacer element projecting from the mounting plate at the exhaust gas inlet, the spacer element defining at least part of the exhaust gas inlet for guiding the exhaust gas flow into the exhaust gas cooler, wherein the spacer element protrudes in a direction of the at least two stacking discs and enlarges a distance between the mounting plate and a proximate stacking disc of the plurality of stacking discs to position the exhaust gas cooler further into the cavity; and wherein the spacer element has a dish shape defining an internal cross-section that decreases in the direction of the at least two stacking discs.

19. The internal combustion engine according to claim 18, wherein the spacer element is structured as a baffle element in a region of the proximate stacking disc for influencing the exhaust gas flow through the exhaust gas cooler.

20. The internal combustion engine according to claim 18, further comprising a surface-enlarging structure disposed on an external side of the spacer element in a region defining at least part the exhaust gas inlet.

* * * * *